US005468414A

United States Patent [19]

Panandiker et al.

[11] Patent Number: 5,468,414

[45] Date of Patent: Nov. 21, 1995

[54] BUILT LIQUID DETERGENTS WITH BORIC-POLYOL COMPLEX TO INHIBIT PROTEOLYTIC ENZYME

[76] Inventors: Rajan K. Panandiker, The Procter & Gamble Company, Ivorydale Technical Center, Cincinnati, Ohio 45217; Christiaan A. J. Thoen; Pierre M. A. Lenoir, both of Procter & Gamble European Technical Center N.V. Temselaan ILL, B-1820 Strombeek-Bever, Belgium

[21] Appl. No.: 361,023

[22] Filed: Dec. 21, 1994

Related U.S. Application Data

[63] Continuation of Ser. No. 38,566, Mar. 26, 1993, abandoned, which is a continuation of Ser. No. 693,515, Apr. 30, 1991, abandoned.

[51] Int. Cl.[6] ..... C11D 3/386; C11D 3/02; C11D 3/18; C11D 3/26

[52] U.S. Cl. ..... 252/135; 252/174.12; 252/DIG. 12; 252/DIG. 14; 252/544; 252/548

[58] Field of Search ..... 252/174.12, DIG. 12, 252/135, DIG. 14, 544, 548; 435/188

[56] References Cited

U.S. PATENT DOCUMENTS

| | | | |
|---|---|---|---|
| 4,261,868 | 4/1981 | Hora et al. | 252/529 |
| 4,532,064 | 7/1985 | Boskamp | 252/174.12 |
| 4,747,977 | 5/1988 | Whitehead et al. | 252/174.12 |
| 5,039,446 | 8/1991 | Estell | 252/174.12 |
| 5,124,066 | 6/1992 | Russell | 252/174.12 |
| 5,221,495 | 6/1993 | Cao | 252/135 |

FOREIGN PATENT DOCUMENTS

| | | |
|---|---|---|
| 0450702A2 | 10/1991 | European Pat. Off. . |
| 2140819 | 12/1984 | United Kingdom . |
| WO91/13904 | 9/1991 | WIPO . |
| WO92/03529 | 3/1992 | WIPO . |
| 9219709 | 11/1992 | WIPO . |

OTHER PUBLICATIONS

Imperiali, B. and Abeles, R. H., "Inhibition of Serine Proteases", Biochemistry, vol. 25, 1986, Easton, Pa. U.S., pp. 3760–3767.

Kettner, C. A. and Shenvi, A. B., "Inhibition of the Serine Proteases Leukocyte Elastase, Pancreatic Elastase, Cathepsin G, and Chymotrypsin by Peptide Boronic Acids", Journal of Biological Chemistry, vol. 259, No. 24, 25 Dec. 1984, pp. 15106–15112.

Dawber et al in the Journal of Chemical Society, vol. 1, pp. 41–56 (1988).

Philipp, M. and Bender, M. L., "Kinetics of Subtilisin and Thiolsubtilisin", Molecular & Cellular Biochemistry, vol. 51, pp. 5–32 (1983).

"Equilibria Between Borate Ion andSome Polyols in Aqueous Solution" by Conner, J. M. and Bulgrin, VC, J. Inorg. Nucl. Chem., 1967, vol. 29, pp. 1953–1961.

Copending Patent Application Ser. No. 693,516, Panandiker et al, filed Apr. 30, 1991.

"Studies on Borate Esters I" by Van Duin, M., Peters, JA, Kieboom, APB, and Van Bekkum, H., from *Tetrahedron*, vol. 40, No. 15, pp. 2901–2911 (1984).

"Raman Study of Aqueous Monoborate–Polyol Complexes. Equilibria in the Monoborate–1,2–Ethanediol System" by Oertel, RP, *Inorganic Chemistry*, vol. 11, No. 3, pp. 554–549.

"Mechanism of the Complexation of Boron Acids with Catechol and Substituted Catechols" by Pizer, R. and Babcock, L., *Inorganic Chemsitry*, vol. 16, No. 7, pp. 1677–1681 (1977).

*Primary Examiner*—Paul Lieberman
*Assistant Examiner*—Kery A. Fries
*Attorney, Agent, or Firm*—G. W. Allen

[57] ABSTRACT

Included are liquid detergent compositions containing alphahydroxyacid builder, anionic and/or nonionic surfactant, proteolytic enzyme, second enzyme, and a mixture of certain vicinal polyols and boric acid or its derivative. The equilibrium constants for the boric/polyol reaction are $K_1$ between about 0.1 and 400 l/mole and $K_2$ between 0 and about 1000 $l^2$/mole$^2$.

1 Claim, No Drawings

BUILT LIQUID DETERGENTS WITH BORIC-POLYOL COMPLEX TO INHIBIT PROTEOLYTIC ENZYME

This is a continuation of U.S. application Ser. No. 08/038,566, filed on Mar. 26, 1993, now abandoned, which is in turn a continuation of abandoned U.S. application Ser. No. 08/693,515, filed on Apr. 30, 1991.

FIELD OF THE INVENTION

This invention relates to liquid detergent compositions containing alphahydroxyacid builder, anionic or nonionic surfactant, proteolytic enzyme, second enzyme, and a mixture of certain vicinal polyols and boric acid or its derivative. More specifically, the equilibrium constants for the boric/polyol reaction are: $K_1$ between about 0.1 and 400 liter/mole and $K_2$ between 0 and about 1000 liters$^2$/mole$^2$.

BACKGROUND OF THE INVENTION

A commonly encountered problem with protease-containing liquid detergents is the degradation of second enzymes in the composition by the proteolytic enzyme. The stability of the second enzyme upon storage in product and its effect on cleaning are impaired by the proteolytic enzyme.

Boric acid and boronic acids are known to reversibly inhibit proteolytic enzymes. A discussion of the inhibition of one serine protease, subtilisin, by boronic acid is provided in Philipp, M. and Bender, M. L., "Kinetics of Subtilisin and Thiolsubtilisin", Molecular & Cellular Biochemistry, vol. 51, pp. 5–32 (1983).

One class of boronic acid, peptide boronic acid, is discussed as an inhibitor of trypsin-like serine proteases, especially in pharmaceuticals, in European Patent Application 0 293 881, Kettner et al., published Dec. 7, 1988.

However, in liquid detergents built with alphahydroxyacid, boric acid and its derivatives appear to complex with the builder and are adversely affected as proteolytic enzyme inhibitors. The proteolytic enzyme then is free to degrade second enzymes in these built liquid detergent compositions. The extent to which the builder complexes with boric acid is believed to be a function of the type of alphahydroxyacid builder, and the type of boric acid derivative which is employed in the composition. For example, the effect is dramatic for boric acid in a protease-containing liquid detergent composition built with citric acid. A second enzyme such as lipase in such a system is degraded by the proteolytic enzyme, rendering the lipase ineffective.

The effectiveness of these boric acid/derivatives can be increased by the addition of a vicinal polyol of the general structure:

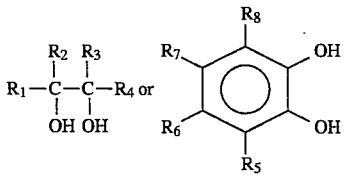

where $R_1$ is selected from the group consisting of $C_1$–$C_6$ alkyl, aryl, substituted $C_1$–$C_6$ alkyl, substituted aryl, nitro, and halogen; $R_2$, $R_3$ and $R_4$ are independently selected from the group consisting of hydrogen, $C_1$–$C_6$ alkyl, aryl, substituted $C_1$–$C_6$ alkyl, substituted aryl, halogen, nitro, ester, amine, amine derivative, substituted amine, hydroxyl, and hydroxyl derivative; $R_1$ and $R_3$ may be linked via a non-aromatic ring; $R_5$, $R_6$, $R_7$, and $R_8$ are independently selected from the group consisting of hydrogen, $C_1$–$C_6$ alkyl, aryl, substituted $C_1$–$C_6$ alkyl, substituted aryl, halogen, nitro, ester, amine, amine derivative, substituted amine, hydroxyl, substituted hydroxyl, aldehyde, acid, sulfonate and phosphonate and at least one $R_5$–$R_8$ is $R_1$. Catechol, 1,2 propane diol and glycerine are preferably not included. The equilibrium constants for the reaction of the two ingredients are: $K_1$ between about 0.1 and 400 l/mole and $K_2$ between 0 and about 1000 l$^2$/mole$^2$.

Without meaning to be bound by theory, it is believed that a predominantly 1:1 boric/polyol complex is formed which is capable of binding with the active site (serine) on the proteolytic enzyme. This is believed to be better than, for example, a 1:2 boric/polyol complex. The boric/polyol mixture is believed not to be compromised by the alphahydroxyacid builder like boric acid and its derivatives alone are. The second enzyme is not degraded by the proteolytic enzyme, which has been reversibly inhibited by the boric/polyol mixture. Upon dilution, such as under typical wash conditions, the proteolytic enzyme is no longer inhibited and can function (e.g. to remove protease-sensitive stains from fabrics in the wash).

The importance for protease inhibition of the low $K_2$ value (below about 1000 l$^2$/mole$^2$) and the importance of 1:1 complexing of the boric:polyol mixture in liquid detergent compositions comprising alphahydroxyacid builder, anionic and/or nonionic surfactant, proteolytic enzyme, and a second enzyme, are not disclosed or taught by the art.

European Patent Application 0 381 262, Aronson et al., published Aug. 8, 1990, mixtures of proteolytic and lipolytic enzymes in a liquid medium are disclosed. The stability of lipolytic enzyme is said to be improved by the addition of a stabilizer system comprising boron compound and a polyol which are capable of reacting with one another, whereby the polyol has a first binding constant of at least 500 l/mole and a second binding constant with the boron compound of at least 1000 l$^2$/mole$^2$.

German Patent 3 918 761, Weiss et al, published Jun. 28, 1990 discloses liquid enzyme concentrate which is said to be usable as a raw material solution for making liquid detergents and the like. The concentrate contains hydrolase, propylene glycol and boric acid or its soluble salt.

U.S. Pat. No. 4,900,475, Ramachandran et al, issued Feb. 13, 1990, discloses a stabilized enzyme-containing detergent containing surface active detergent material, builder salt and an effective amount of enzyme or enzyme mixture selected from the group containing protease and alpha-amylase enzymes. The composition also contains a stabilization system comprised of glycerine, a boron compound and a carboxylic compound with 2–8 carbon compounds.

U.S. Pat. No. 4,537,707, Severson, Jr., issued Aug. 27, 1985 describes heavy duty liquid detergents containing anionic surfactant, fatty acid, builder, proteolytic enzyme, boric acid, calcium ions and sodium formate. The combination of boric acid and formate provides improved proteolytic enzyme stability in the compositions.

European Patent Application 0 080 223, Boskamp et al, published Jun. 1, 1983 describes aqueous enzymatic detergent compositions containing boric acid or an alkali metal borate with a polyfunctional amino compound or a polyol, together with a reducing alkali metal salt.

Similarly in GB 2 079 305, Boskamp, published Jan. 20, 1982, it is disclosed that enhanced enzyme stability can be obtained in a built liquid detergent composition by inclusion of a mixture boric acid and polyol in a weight ratio of more than 1:1, and a cross linked neutralized polyacrylate polymer.

The procedure used to determine thermodynamic constants for boric/polyol complexes is based on $^{11}$Boron NMR as described by Dawber et al in the Journal of Chemical Society, Volume 1, pages 41–56 (1988). Thermodynamic constants for some of the compounds of interest are listed in the above article.

SUMMARY OF THE INVENTION

The present invention relates to a liquid detergent composition containing:

a. a mixture of (1) from about 0.1 to 30 weight % of the composition of vicinal polyol of the structure

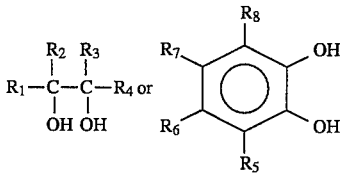

where $R_1$ is selected from the group consisting of $C_1$–$C_6$ alkyl, aryl, substituted $C_1$–$C_6$ alkyl, substituted aryl, nitro, and halogen; $R_2$, $R_3$ and $R_4$ are independently selected from the group consisting of hydrogen, $C_1$–$C_6$ alkyl, aryl, substituted $C_1$–$C_6$ alkyl, substituted aryl, halogen, nitro, ester, amine, amine derivative, substituted amine, hydroxyl and hydroxyl derivative; $R_5$, $R_6$, $R_7$, and $R_8$ are independently selected from the group consisting of hydrogen, $C_1$–$C_6$ alkyl, aryl, substituted $C_1$–$C_6$ alkyl, substituted aryl, halogen, nitro, ester, amine, amine derivative, substituted amine, aldehyde, acid, sulfonate and phosphonate; and at least one $R_{5\text{-}8}$ is $R_1$; and (2) from about 0.05 to 20 weight % of the composition of boric acid or its derivative;

wherein the equilibrium constants for the reaction between (1) and (2) are: $K_1$ between about 0.1 and 400 l/mole and $K_2$ between 0 and about 1000 $l^2$/mole2;

b. from about 0.0001 to 1.0 weight % of active proteolytic enzyme;

c. a performance-enhancing amount of a detergent-compatible second enzyme;

d. from about 1 to 80 weight % of anionic or nonionic surfactant; and e. from about 0.1 to 30 weight % of alphahydroxyacid builder.

DESCRIPTION OF THE INVENTION

The present liquid detergent compositions contain certain essential ingredients: (a) mixture of vicinal polyol and boric acid or its derivative; (b) proteolytic enzyme; (c) detergent-compatible second enzyme; (d) anionic and/or nonionic detersive surfactant; and (e) alphahydroxyacid builder. These compositions will most commonly be used for cleaning of laundry, fabrics, textiles, fibers, and hard surfaces. Heavy duty liquid laundry detergents are the preferred liquid detergent compositions herein.

A. Polyol/Boric Mixture

The present liquid detergent compositions contain a mixture of vicinal polyol of the general structure;

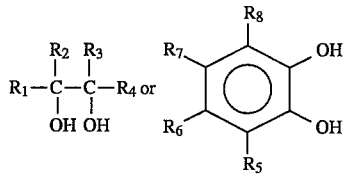

where $R_1$ is selected from the group consisting of $C_1$–$C_6$ alkyl, aryl, substituted $C_1$–$C_6$ alkyl, substituted aryl, nitro, and halogen; $R_2$, $R_3$ and $R_4$ are independently selected from the group consisting of hydrogen, $C_1$–$C_6$ alkyl, aryl, substituted $C_1$–$C_6$ alkyl, substituted aryl, halogen, nitro, ester, amine, amine derivative, substituted amine, hydroxyl and hydroxyl derivative; where $R_5$, $R_6$, $R_7$, and $R_8$ are independently selected from the group consisting of hydrogen, $C_1$–$C_6$ alkyl, aryl, substituted alkyl, substituted aryl, halogen, nitro, ester, amine, amine derivative, substituted amine, hydroxyl, aldehyde, acid, sulfonate or phosphonate; and boric acid or its derivative (called herein "polyol/boric" or "boric/polyol").

The equilibrium constants for the polyol/boric reaction are $K_1$ between about 0.1 and 400 l/mole and $K_2$ between 0 and about 1000 $l^2$/mole$^2$. The preferred ratio of $K_2/K_1$ is $\leqq 20$, preferably between about 1 and 5. The equilibrium reaction is as follows:

$$B + P \underset{}{\overset{K_1}{\rightleftharpoons}} BP \qquad K1 = \frac{[BP]}{[B]\,[P]}$$

$$B + 2P \underset{}{\overset{K_2}{\rightleftharpoons}} BP2 \qquad K_2 = \frac{[BP_2]}{[B]\,[P]^2}$$

where "B" is boric acid or its derivative and "P" is vicinal polyol. $K_1$ is the first equilibrium constant and indicates the formation of 1:1 boric:polyol complexes. $K_2$ is the second equilibrium constant. It indicates the formation of 1:2 boric:polyol complexes. It is believed that a significantly large $K_2$ and a small $K_1$ results in the formation of a predominantly 1:2 boric/polyol complex. Conversely, a large $K_1$ and a relatively small generally $K_2$ results in 1:1 boric/polyol complex formation, which is preferred herein. For example, it has been shown by Pizer & Babcock in "Mechanism of Complexation of Boron Acids with Catechol and Substituted Catechols" that mannitol ($K_1$=237 $K_2$=7424) forms a 2:1 complex with boric acid, whereas catechol ($K_1$=129 $K_2$=2.4) forms a 1:1 complex.

It is preferred that the vicinal polyol and boric acid/derivative be mixed together within a few days prior to the addition to the liquid detergent. This is done by neutralizing boric acid with an inorganic/organic alkali not capable of complexing with boric acid/derivative. These include sodium hydroxide and potassium hydroxide. This is followed by addition of the vicinal polyol at room temperature. The complex may also be formed in-situ in a liquid laundry detergent composition by addition of boric acid or its salt and the polyol directly to the composition.

Boric-polyol premix can be added to the detergent composition. The final concentration of boric acid in the detergent composition is between about 0.05 and 20% by weight and the final concentration of vicinal polyol is between about 0.1 and 30% by weight. Preferably, the concentration of boric acid or its derivative in the composition is between about 0.1 and 10 weight % and most preferably between about 0.5 and 5 weight %. The concentration of vicinal polyol in the composition is preferably between about 0.2 and 20, most preferably between about 1 and 20, weight %.

$K_1$ is between about 0.1 and 400 l/mole, preferably between about 0.2 and 200 l/mole; and $K_2$ is between about 0 and 1000 $l^2/mole^2$, preferably between about 0.1 and 200 $l^2/mole^2$, more preferably between about 0.2 and 100 $l^2/mole^2$.

The boric/polyol molar ratio is preferably between about 20:1 and 1:20, more preferably between about 6:1 and 1:15, most preferably between 3:1 and 1:10.

The ratio of this mixture of boric acid derivative and vicinal polyol to alphahydroxyacid builder is preferably between about 10:1 and 1:30, most preferably between about 5:1 and 1:10.

The boric acid or its derivative used in the mixture includes boric acid, borax, boric oxide, polyborates, orthoborates, pyroborates, metaborates, or mixtures thereof. Salts of these compounds are included. Preferred compounds are the alkali salts of boric acid, such as sodium borate. These salts can be formed in the formulation by in-situ neutralization of boric acid with an appropriate alkali.

The vicinal polyol herein is a compound with two or more hydroxyl groups, at least two of which are on adjacent carbon atoms. It has the general structure described above. As defined here, $R_1$ and $R_3$ may be linked by a non-aromatic ring (cyclopentyl or cyclohexyl ). Catechol, 1,2 propanediol and glycerine are preferably not included herein.

Preferably, $R_1$ on the vicinal polyol is $C_1$–$C_6$ alkyl, substituted $C_1$–$C_6$ alkyl, phenyl or substituted phenyl and $R_2$, $R_3$, and $R_4$ are hydrogen. More preferred vicinal polyols are 1,2 butanediol, 1,2 hexanediol, 3 chloro 1,2 propane diol, propylgallate, gallic acid, 1 phenyl, 1,2 ethanediol, and 1 ethoxy 2,3 propanediol. Most preferred are 1,2 butanediol, 1,2 hexanediol, 3 chloro 1,2 propane diol, 1 phenyl 1,2 ethanediol, and propylgallate.

B. Proteolytic Enzyme

A second essential ingredient in the present liquid detergent compositions is from about 0.0001 to 1.0, preferably about 0.0005 to 0.3, most preferably about 0.002 to 0.1, weight % of active proteolytic enzyme. Mixtures of proteolytic enzyme are al so included. The proteolytic enzyme can be of animal, vegetable or microorganism (preferred) origin. More preferred is serine proteolytic enzyme of bacterial origin. Purified or nonpurified forms of this enzyme may be used. Proteolytic enzymes produced by chemically or genetically modified mutants are included. Particularly preferred is bacterial serine proteolytic enzyme obtained from *Bacillus subtilis* and/or *Bacillus licheniformis.*

Suitable proteolytic enzymes include Alcalase®, Esperase®, Savinase®(preferred); Maxatase®, Maxacal® (preferred), and Maxapem 15® (protein engineered Maxacal®); and subtilisin BPN and BPN' (preferred); which are commercially available. Preferred proteolytic enzymes are also modified bacterial serine proteases, such as those described in European Patent Application Serial Number 87 303761.8, filed Apr. 28, 1987 (particularly pages 17, 24 and 98), and which is called herein "Protease B", and in European Patent Application 199,404, Venegas, published Oct. 29, 1986, which refers to a modified bacterial serine proteolytic enzyme which is called "Protease A" herein. Preferred proteolytic enzymes, then, are selected from the group consisting of Savinase®, Maxacal®, BPN', Protease A and Protease B, and mixtures thereof. Protease B is most preferred.

C. Second Enzyme

The third essential ingredient in the present liquid compositions is a performance-enhancing amount of a detergent-compatible second enzyme. By "detergent-compatible" is meant compatibility with the other ingredients of a liquid detergent composition, such as detersive surfactant and detergency builder. These second enzymes are preferably selected from the group consisting of lipase, amylase, cellulase, and mixtures thereof. The term "second enzyme" excludes the proteolytic enzymes discussed above, so each composition herein contains at least two kinds of enzyme, including at least one proteolytic enzyme.

The amount of second enzyme used in the composition varies according to the type of enzyme and the use intended. In general, from about 0.0001 to 1.0, more preferably 0.001 to 0.5, weight % on an active basis of these second enzymes are preferably used.

Mixtures of enzymes from the same class (e.g. lipase) or two or more classes (e.g. cellulase and lipase) may be used. Purified or non-purified forms of the enzyme may be used.

Any lipase suitable for use in a liquid detergent composition can be used herein. Suitable lipases for use herein include those of bacterial and fungal origin. Second enzymes from chemically or genetically modified mutants are included.

Suitable bacterial lipases include those produced by Pseudomonas, such as *Pseudomonas stutzeri* ATCC 19.154, as disclosed in British Patent 1,372,034, incorporated herein by reference. Suitable lipases include those which show a positive immunological cross-reaction with the antibody of the lipase produced by the microorganism *Pseudomonas fluorescens* IAM 1057. This lipase and a method for its purification have been described in Japanese Patent Application 53-20487, laid open on Feb. 24, 1978, which is incorporated herein by reference. This lipase is available under the trade name Lipase P "Amano," hereinafter referred to as "Amano-P." Such lipases should show a positive immunological cross reaction with the Amano-P antibody, using the standard and well-known immunodiffusion procedure according to Ouchterlony (Acta. Med. Scan., 133, pages 76–79 (1950)). These lipases, and a method for their immunological cross-reaction with Amano-P, are also described in U.S. Pat. No. 4,707,291, Thom et al., issued Nov. 17, 1987, incorporated herein by reference. Typical examples thereof are the Amano-P lipase, the lipase ex *Pseudomonas fragi* FERM P 1339 (available under the trade name Amano-B), lipase ex *Psuedomonas nitroreducens* var. lipolyticum FERM P 1338 (available under the trade name Amano-CES), lipases ex *Chromobacter viscosum,* e.g. *Chromobacter viscosum* var. lipolyticum NRRLB 3673, and further *Chromobacter viscosum* lipases, and lipases ex *Pseudomonas gladioli.* Other lipases of interest are Amano AKG and Bacillis Splipase.

Suitable fungal lipases include those producible by *Humicola lanuginosa* and *Thermomyces lanuqinosus.* Most preferred is lipase obtained by cloning the gene from *Humicola lanuginosa* and expressing the gene in *Aspergillus oryzae* as described in European Patent Application 0 258 068, incorporated herein by reference, commercially available under the trade name Lipolase®.

From about 2 to 20,000, preferably about 10 to 6,000, lipase units of lipase per gram (LU/g) of product can be used in these compositions. A lipase unit is that amount of lipase which produces 1 μmol of titratable butyric acid per minute in a pH stat, where pH is 7.0, temperature is 30° C., and substrate is an emulsion of tributyrin, and gum arabic, in the presence of $Ca^{++}$ and NaCl in phosphate buffer.

Any cellulase suitable for use in a liquid detergent composition can be used in these compositions. Suitable cellulase enzymes for use herein include those of bacterial and fungal origins. Preferably, they will have a pH optimum of between 5 and 9.5. From about 0.0001 to 1.0, preferably 0.001 to 0.5, weight % on an active enzyme basis of cellulase can be used.

Suitable cellulases are disclosed in U.S. Pat. No. 4,435,307, Barbesgaard et al., issued Mar. 6, 1984, incorporated herein by reference, which discloses fungal cellulase produced from *Humicola insolens*. Suitable cellulases are also disclosed in GB-A-2.075.028, GB-A-2.095.275 and DE-OS-2.247.832.

Examples of such cellulases are cellulases produced by a strain of *Humicola insolens* (*Humicola grisea* var. thermoidea), particularly the Humicola strain DSM 1800, and cellulases produced by a fungus of Bacillus N or a cellulase 212-producing fungus belonging to the genus Aeromonas, and cellulase extracted from the hepatopancreas of a marine mollusc (Dolabella Auricula Solander).

Any amylase suitable for use in a liquid detergent composition can be used in these compositions. Amylases include, for example, α-amylases obtained from a special strain of *B. licheniforms*, described in more detail in British Patent Specification No. 1,296,839. Amylolytic proteins include, for example, Rapidase™, Maxamyl™ and Termamyl™.

From about 0.0001% to 1.0, preferably 0.0005 to 0.5, weight % on an active enzyme basis of amylase can be used.

D. Detersive Surfactant

From about 1 to 80, preferably about 5 to 50, most preferably about 10 to 30, weight % of anionic or nonionic detersive surfactant is the fourth essential ingredient in the present invention. The detersive surfactant can be selected from the group consisting of anionics and nonionics and optionally cationics, ampholytics, zwitterionics, and mixtures thereof. It is preferred that no significant amounts of surfactants other than anionic and nonionic surfactants be included.

Preferably the anionic surfactant is $C_{12}$–$C_{20}$ alkyl sulfate, $C_{12}$–$C_{20}$ alkyl ether sulfate and/or $C_9$–$C_{20}$ linear alkylbenzene sulfonate. Preferably the nonionic surfactant is the condensation product of $C_{10}$–$C_{20}$ alcohol and between 2–20 moles of ethylene oxide per mole of alcohol or polyhydroxy $C_{10-20}$ fatty acid amide.

Anionic Surfactants

One type of anionic surfactant which can be utilized is alkyl ester sulfonates. These are desirable because they can be made with renewable, non-petroleum resources. Preparation of the alkyl ester sulfonate surfactant component is according to known methods disclosed in the technical literature. For instance, linear esters of $C_8$–$C_{20}$ carboxylic acids can be sulfonated with gaseous $SO_3$ according to "The Journal of the American Oil Chemists Society," 52 (1975), pp. 323–329. Suitable starting materials would include natural fatty substances as derived from tallow, palm, and coconut oils, etc.

The preferred alkyl ester sulfonate surfactant, especially for laundry applications, comprises alkyl ester sulfonate surfactants of the structural formula:

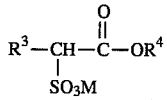

wherein $R^3$ is a $C_8$–$C_{20}$ hydrocarbyl, preferably an alkyl, or combination thereof, $R^4$ is a $C_1$–$C_6$ hydrocarbyl, preferably an alkyl, or combination thereof, and M is a soluble salt-forming cation. Suitable salts include metal salts such as sodium, potassium, and lithium salts, and substituted or unsubstituted ammonium salts, such as methyl-, dimethyl, -trimethyl, and quaternary ammonium cations, e.g. tetramethyl-ammonium and dimethyl piperydinium, and cations derived from alkanolamines, e.g. monoethanolamine, diethanolamine, and triethanolamine. Preferably, $R^3$ is $C_{10}$–$C_{16}$ alkyl, and $R^4$ is methyl, ethyl or isopropyl. Especially preferred are the methyl ester sulfonates wherein $R^3$ is $C_{14}$–$C_{16}$ alkyl.

Alkyl sulfate surfactants are another type of anionic surfactant of importance for use herein. In addition to providing excellent overall cleaning ability when used in combination with polyhydroxy fatty acid amides (see below), including good grease/oil cleaning over a wide range of temperatures, wash concentrations, and wash times, dissolution of alkyl sulfates can be obtained, as well as improved formulability in liquid detergent formulations are water soluble salts or acids of the formula $ROSO_3M$ wherein R preferably is a $C_{10}$–$C_{24}$ hydrocarbyl, preferably an alkyl or hydroxyalkyl having a $C_{10}$–$C_{20}$ alkyl component, more preferably a $C_{12}$–$C_{18}$ alkyl or hydroxyalkyl, and M is H or a cation, e.g., an alkali metal cation (e.g., sodium, potassium, lithium), substituted or unsubstituted ammonium cations such as methyl-, dimethyl-, and trimethyl ammonium and quaternary ammonium cations, e.g., tetramethyl-ammonium and dimethyl piperdinium, and cations derived from alkanolamines such as ethanolamine, diethanolamine, triethanolamine, and mixtures thereof, and the like. Typically, alkyl chains of $C_{12-16}$ are preferred for lower wash temperatures (e.g., below about 50° C.) and $C_{16-18}$ alkyl chains are preferred for higher wash temperatures (e.g., above about 50° C.).

Alkyl alkoxylated sulfate surfactants are another category of useful anionic surfactant. These surfactants are water soluble salts or acids typically of the formula $RO(A)_mSO_3M$ wherein R is an unsubstituted $C_{10}$–$C_{24}$ alkyl or hydroxyalkyl group having a $C_{10}$–$C_{24}$ alkyl component, preferably a $C_{12}$–$C_{20}$ alkyl or hydroxyalkyl, more preferably $C_{12}$–$C_{18}$ alkyl or hydroxyalkyl, A is an ethoxy or propoxy unit, m is greater than zero, typically between about 0.5 and about 6, more preferably between about 0.5 and about 3, and M is H or a cation which can be, for example, a metal cation (e.g., sodium, potassium, lithium, calcium, magnesium, etc.), ammonium or substituted-ammonium cation. Alkyl ethoxylated sulfates as well as alkyl propoxylated sulfates are contemplated herein. Specific examples of substituted ammonium cations include methyl-, dimethyl-, trimethylammonium and quaternary ammonium cations, such as tetramethyl-ammonium, dimethyl piperydinium and cations derived from alkanolamines, e.g. monoethanolamine, diethanolamine, and triethanolamine, and mixtures thereof. Exemplary surfactants are $C_{12}$–$C_{18}$ alkyl polyethoxylate (1.0) sulfate, $C_{12}$–$C_{18}$ alkyl polyethoxylate (2.25) sulfate, $C_{12}$–$C_{18}$ alkyl polyethoxylate (3.0) sulfate, and $C_{12}$–$C_{18}$ alkyl polyethoxylate (4.0) sulfate wherein M is conveniently selected from sodium and potassium.

Other Anionic Surfactants

Other anionic surfactants useful for detersive purposes can also be included in the compositions hereof. These can include salts (including, for example, sodium, potassium, ammonium, and substituted ammonium salts such as mono-, di- and triethanolamine salts) of soap, $C_9$–$C_{20}$ linear alkylbenzenesulphonates, $C_8$–$C_{22}$ primary or secondary alkanesulphonates, $C_8$–C24 olefinsulphonates, sulphonated polycarboxylic acids prepared by sulphonation of the pyrolyzed product of alkaline earth metal citrates, e.g., as described in British Patent Specification No. 1,082,179, alkyl glycerol sulfonates, fatty acyl glycerol sulfonates, fatty oleyl glycerol sulfates, alkyl phenol ethylene oxide ether sulfates, paraffin sulfonates, alkyl phosphates, isothionates such as the acyl isothionates, N-acyl taurates, fatty acid amides of methyl tauride, alkyl succinamates and sulfosuccinates, monoesters of sulfosuccinate (especially saturated and unsaturated $C_{12}$–$C_{18}$ monoesters) diesters of sulfosuccinate (especially saturated and unsaturated $C_6$–$C_{14}$ diesters), N-acyl sarcosinates, sulfates of alkylpolysaccharides such as the sulfates of alkylpolyglucoside (the nonionic nonsulfated compounds being described below), branched primary alkyl sulfates, alkyl polyethoxy carboxylates such as those of the formula $RO(CH_2CH_2O)_kCH_2COO—M^+$ wherein R is a $C_8$–$C_{22}$ alkyl, k is an integer from 0 to 10, and M is a soluble salt-forming cation, and fatty acids esterified with isethionic acid and neutralized with sodium hydroxide. Resin acids and hydrogenated resin acids are also suitable, such as rosin, hydrogenated rosin, and resin acids and hydrogenated resin acids present in or derived from tall oil. Further examples are given in "Surface Active Agents and Detergents" (Vol. I and II by Schwartz, Perry and Berch). A variety of such surfactants are also generally disclosed in U.S. Pat. No. 3,929,678, issued Dec. 30, 1975 to Laughlin, et al. at Column 23, line 58 through Column 29, line 23 (herein incorporated by reference).

Nonionic Detergent Surfactants

Suitable nonionic detergent surfactants are generally disclosed in U.S. Pat. No. 3,929,678, Laughlin et al., issued Dec. 30, 1975, at column 13, line 14 through column 16, line 6, incorporated herein by reference. Exemplary, non-limiting classes of useful nonionic surfactants are listed below.

1. The polyethylene, polypropylene, and polybutylene oxide condensates of alkyl phenols. In general, the polyethylene oxide condensates are preferred. These compounds include the condensation products of alkyl phenols having an alkyl group containing from about 6 to about 12 carbon atoms in either a straight chain or branched chain configuration with the alkylene oxide. In a preferred embodiment, the ethylene oxide is present in an amount equal to from about 5 to about 25 moles of ethylene oxide per mole of alkyl phenol. Commercially available nonionic surfactants of this type include Igepal™ CO-630, marketed by the GAF Corporation; and Triton™ X-45, X-114, X-100, and X-102, all marketed by the Rohm & Haas Company. These compounds are commonly referred to as alkyl phenol alkoxylates, (e.g., alkyl phenol ethoxylates).
2. The condensation products of aliphatic alcohols with from about 1 to about 25 moles of ethylene oxide. The alkyl chain of the aliphatic alcohol can either be straight or branched, primary or secondary, and generally contains from about 8 to about 22 carbon atoms. Particularly preferred are the condensation products of alcohols having an alkyl group containing from about 10 to about 20 carbon atoms with from about 2 to about 18 moles of ethylene oxide per mole of alcohol. Examples of commercially available nonionic surfactants of this type include Tergitol™ 15-S-9 (the condensation product of $C_{11}$–$C_{15}$ linear secondary alcohol with 9 moles ethylene oxide), Tergitol™ 24-L-6 NMW (the condensation product of $C_{12}$–$C_{14}$ primary alcohol with 6 moles ethylene oxide with a narrow molecular weight distribution), both marketed by Union Carbide Corporation; Neodol™ 45-9 (the condensation product of $C_{14}$–$C_{15}$ linear alcohol with 9 moles of ethylene oxide), Neodol™ 23–6.5 (the condensation product of $C_{12}$–$C_{13}$ linear alcohol with 6.5 moles of ethylene oxide), Neodol™ 45-7 (the condensation product of $C_{14}$–$C_{15}$ linear alcohol with 7 moles of ethylene oxide), Neodol™ 45-4 (the condensation product of $C_{14}$–$C_{15}$ linear alcohol with 4 moles of ethylene oxide), marketed by Shell Chemical Company, and Kyro™ EOB (the condensation product of $C_{13}$–$C_{15}$ alcohol with 9 moles ethylene oxide), marketed by The Procter & Gamble Company. This category of nonionic surfactant is referred to generally as "alkyl ethoxylates."
3. The condensation products of ethylene oxide with a hydrophobic base formed by the condensation of propylene oxide with propylene glycol. The hydrophobic portion of these compounds preferably has a molecular weight of from about 1500 to about 1800 and exhibits water insolubility. The addition of polyoxyethylene moieties to this hydrophobic portion tends to increase the water solubility of the molecule as a whole, and the liquid character of the product is retained up to the point where the polyoxyethylene content is about 50% of the total weight of the condensation product, which corresponds to condensation with up to about 40 moles of ethylene oxide. Examples of compounds of this type include certain of the commercially-available Pluronic™ surfactants, marketed by BASF.
4. The condensation products of ethylene oxide with the product resulting from the reaction of propylene oxide and ethylenediamine. The hydrophobic moiety of these products consists of the reaction product of ethylenediamine and excess propylene oxide, and generally has a molecular weight of from about 2500 to about 3000. This hydrophobic moiety is condensed with ethylene oxide to the extent that the condensation product contains from about 40% to about 80% by weight of polyoxyethylene and has a molecular weight of from about 5,000 to about 11,000. Examples of this type of nonionic surfactant include certain of the commercially available Tetronic™ compounds, marketed by BASF.
5. Semi-polar nonionic surfactants are a special category of nonionic surfactants which include water-soluble amine oxides containing one alkyl moiety of from about 10 to about 18 carbon atoms and 2 moieties selected from the group consisting of alkyl groups and hydroxyalkyl groups containing from about 1 to about 3 carbon atoms; water-soluble phosphine oxides containing one alkyl moiety of from about 10 to about 18 carbon atoms and 2 moieties selected from the group consisting of alkyl groups and hydroxyalkyl groups containing from about 1 to about 3 carbon atoms; and water-soluble sulfoxides containing one alkyl moiety of from about 10 to about 18 carbon atoms and a moiety selected from the group consisting of alkyl and hydroxyalkyl moieties of from about 1 to about 3 carbon atoms.

Semi-polar nonionic detergent surfactants include the amine oxide surfactants having the formula $$R^3(OR^4)_xN(\overset{O}{\overset{|}{}}R^5)_2$$

wherein $R^3$ is an alkyl, hydroxyalkyl, or alkyl phenyl group or mixtures thereof containing from about 8 to about 22 carbon atoms; $R^4$ is an alkylene or hydroxyalkylene group containing from about 2 to about 3 carbon atoms or mixtures thereof; x is from 0 to about 3; and each $R^5$ is an alkyl or hydroxyalkyl group containing from about 1 to about 3 carbon atoms or a polyethylene oxide group containing from about 1 to about 3 ethylene oxide groups. The $R^5$ groups can be attached to each other, e.g., through an oxygen or nitrogen atom, to form a ring structure.

These amine oxide surfactants in particular include $C_{10}$–$C_{18}$ alkyl dimethyl amine oxides and $C_8$–$C_{12}$ alkoxy ethyl dihydroxy ethyl amine oxides.

6. Alkylpolysaccharides disclosed in U.S. Pat. No. 4,565,647, Llenado, issued Jan. 21, 1986, having a hydrophobic group containing from about 6 to about 30 carbon atoms, preferably from about 10 to about 16 carbon atoms and a polysaccharide, e.g., a polyglycoside, hydrophilic group containing from about 1.3 to about 10, preferably from about 1.3 to about 3, most preferably from about 1.3 to about 2.7 saccharide units. Any reducing saccharide containing 5 or 6 carbon atoms can be used, e.g., glucose, galactose and galactosyl moieties can be substituted for the glucosyl moieties. (Optionally the hydrophobic group is attached at the 2-, 3-, 4-, etc. positions thus giving a glucose or galactose as opposed to a glucoside or galactoside.) The intersaccharide bonds can be, e.g., between the one position of the additional saccharide units and the 2-, 3-, 4-, and/or 6-positions on the preceding saccharide units.

Optionally, and less desirably, there can be a polyalkyleneoxide chain joining the hydrophobic moiety and the polysaccharide moiety. The preferred alkyleneoxide is ethylene oxide. Typical hydrophobic groups include alkyl groups, either saturated or unsaturated, branched or unbranched containing from about 8 to about 18, preferably from about 10 to about 16, carbon atoms. Preferably, the alkyl group is a straight chain saturated alkyl group. The alkyl group can contain up to about 3 hydroxy groups and/or the polyalkyleneoxide chain can contain up to about 10, preferably less than 5, alkyleneoxide moieties. Suitable alkyl polysaccharides are octyl, nonyldecyl, undecyldodecyl, tridecyl, tetradecyl, pentadecyl, hexadecyl, heptadecyl, and octadecyl, di-, tri-, tetra-, penta-, and hexaglucosides, galactosides, lactosides, glucoses, fructosides, fructoses and/or galactoses. Suitable mixtures include coconut alkyl, di-, tri-, tetra-, and pentaglucosides and tallow alkyl tetra-, penta-, and hexa-glucosides.

The preferred alkylpolyglycosides have the formula $$R^2O(C_nH_{2n}O)_t(\text{glycosyl})_x$$

wherein $R^2$ is selected from the group consisting of alkyl, alkylphenyl, hydroxyalkyl, hydroxyalkylphenyl, and mixtures thereof in which the alkyl groups contain from about 10 to about 18, preferably from about 12 to about 14, carbon atoms; n is 2 or 3, preferably 2; t is from 0 to about 10, preferably 0; and x is from about 1.3 to about 10, preferably from about 1.3 to about 3, most preferably from about 1.3 to about 2.7. The glycosyl is preferably derived from glucose. To prepare these compounds, the alcohol or alkyl polyethoxy alcohol is formed first and then reacted with glucose, or a source of glucose, to form the glucoside (attachment at the 1-position). The additional glycosyl units can then be attached between their 1-position and the preceding glycosyl units 2-, 3-, 4- and/or 6-position, preferably predominately the 2-position.

7. Fatty acid amide surfactants having the formula:

$$R^6-\overset{\overset{\displaystyle O}{\|}}{C}-N(R^7)_2$$

wherein $R^6$ is an alkyl group containing from about 7 to about 21 (preferably from about 9 to about 17) carbon atoms and each $R^7$ is selected from the group consisting of hydrogen, $C_1$–$C_4$ alkyl, $C_1$–$C_4$ hydroxyalkyl, and $-(C_2H_4O)_xH$ where x varies from about 1 to about 3.

Preferred amides are $C_8$–$C_{20}$ ammonia amides, monoethanolamides, diethanolamides, and isopropanolamides.

Polyhydroxy Fatty Acid Amide Nonionic Surfactant

The liquid detergent compositions hereof preferably contain an "enzyme performance-enhancing amount" of polyhydroxy fatty acid amide surfactant. By "enzyme-enhancing" is meant that the formulator of the composition can select an amount of polyhydroxy fatty acid amide to be incorporated into the composition that will improve enzyme cleaning performance of the detergent composition. In general, for conventional levels of enzyme, the incorporation of about 1%, by weight, polyhydroxy fatty acid amide will enhance enzyme performance.

The detergent compositions hereof will typically comprise at least about 1 weight % polyhydroxy fatty acid amide surfactant and preferably will comprise from about 3% to 50%, most preferably from about 3% to 30%, of the polyhydroxy fatty acid amide.

The polyhydroxy fatty acid amide surfactant component comprises compounds of the structural formula:

$$R^2-\overset{\overset{\displaystyle O}{\|}}{C}-\overset{\overset{\displaystyle R^1}{|}}{N}-Z \qquad \text{(I)}$$

wherein: $R^1$ is H, $C_1$–$C_4$ hydrocarbyl, 2-hydroxy ethyl, 2-hydroxy propyl, or a mixture thereof, preferably $C_1$–$C_4$ alkyl, more preferably $C_1$ or $C_2$ alkyl, most preferably $C_1$ alkyl ( i.e., methyl); and $R^2$ is a $C_5$–$C_{31}$ hydrocarbyl, preferably straight chain $C_7$–$C_{19}$ alkyl or alkenyl, more preferably straight chain $C_9$–$C_{17}$ alkyl or alkenyl, most preferably straight chain $C_{11}$–$C_{15}$ alkyl or alkenyl, or mixtures thereof; and Z is a polyhydroxyhydrocarbyl having a linear hydrocarbyl chain with at least 3 hydroxyls directly connected to the chain, or an alkoxylated derivative (preferably ethoxylated or propoxylated) thereof. Z preferably will be derived from a reducing sugar in a reductive amination reaction; more preferably Z will be a glycityl. Suitable reducing sugars include glucose, fructose, maltose, lactose, galactose, mannose, and xylose. As raw materials, high dextrose corn syrup, high fructose corn syrup, and high maltose corn syrup can be utilized as well as the individual sugars listed above. These corn syrups may yield a mix of sugar components for Z. It should be understood that it is by no means intended to exclude other suitable raw materials. Z preferably will be selected from the group consisting of $-CH_2-(CHOH)_n-CH_2OH$, $-CH(CH_2OH)-(CHOH)_{n-1}-CH_2OH$, $-CH_2-(CHOH)_2(CHOR')(CHOH)-CH_2OH$, and alkoxylated derivatives thereof, where n is an integer from 3 to 5, inclusive, and R' is H or a cyclic or aliphatic monosaccharide. Most preferred are glycityls wherein n is 4, particularly $-CH_2-(CHOH)_4-CH_2OH$.

In Formula (I), R' can be, for example, N-methyl, N-ethyl, N-propyl, N-isopropyl, N-butyl, N-2-hydroxy ethyl, or N-2-hydroxy propyl.

$R^2-CO-N<$ can be, for example, cocamide, stearamide, oleamide, lauramide, myristamide, capricamide, palmitamide, tallowamide, etc.

Z can be 1-deoxyglucityl, 2-deoxyfructityl, 1-deoxymaltityl, 1-deoxylactityl, 1-deoxygalactityl, 1-deoxymannityl, 1-deoxymaltotriotityl, etc.

Methods for making polyhydroxy fatty acid amides are known in the art. In general, they can be made by reacting an alkyl amine with a reducing sugar in a reductive amination reaction to form a corresponding N-alkyl polyhydroxyamine, and then reacting the N-alkyl polyhydroxyamine with a fatty aliphatic ester or triglyceride in a condensation/amidation step to form the N-alkyl, N-polyhydroxy fatty acid amide product. Processes for making compositions containing polyhydroxy fatty acid amides are disclosed, for example, in G.B. Patent Specification 809,060, published Feb. 18, 1959, U.S. Pat. No. 2,965,576, issued Dec. 20, 1960 to E. R. Wilson, and U.S. Pat. No. 2,703,798, Anthony M. Schwartz, issued Mar. 8, 1955, and U.S. Pat. No. 1,985,424, issued Dec. 25, 1934 to Piggott, each of which is incorporated herein by reference.

E. Alphahydroxyacid Builder

The last essential ingredient is from about 0.1 to 30, preferably about 1 to 20, weight % of alphahydroxy acid builder. By alphahydroxy acid builder is meant that the builder salt has one or more carboxyl groups and one or more hydroxyl groups such that at least one hydroxyl is on the carbon alpha to the one bearing a carboxyl group.

A specific class of alphahydroxy acids useful as builders in the present invention includes those having the general formula:

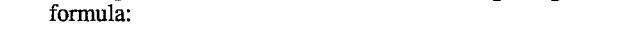

$$CH(A)(COOX)—CH(COOX)—O—CH(COOX)—CH(COOX)(B)$$

wherein A is hydroxyl; B is hydrogen or —O—CH(COOX)—$CH_2$(COOX); and X is hydrogen or a salt-forming cation. If B is H, then the compound is tartrate monosuccinic acid (TMS) and its water-soluble salts. It is preferred that the above alphahydroxy acid (TMS) be mixed with tartrate disuccinate (TDS) represented by the above chemical structure wherein A is H and B is O—CH(COOX)—$CH_2$(COOX). Particularly preferred are mixtures of TMS and TDS in a weight ratio of TMS to TDS of from about 97:3 to about 20:80, most preferably 80 TMS:20 TDS. These builders are disclosed in U.S. Pat. No. 4,663,071, issued to Bush et al., on May 5, 1987.

A preferred alphahydroxy acid useful in this composition is citric acid, its salt and its derivatives. Citrate builders, (particularly sodium salt), are of particular importance for heavy duty liquid detergent formulations herein.

F. Optional Ingredients

Other Detergency Builders

In addition to the alphahydroxy acid builders described above, the composition may contain from 0 to about 50, more preferably about 2 to 30, weight percent of other detergency builders. Inorganic as well as organic builders can be used.

Inorganic detergency builders include, but are not limited to, the alkali metal, ammonium and alkanolammonium salts of polyphosphates (exemplified by the tripolyphosphates, pyrophosphates, and glassy polymeric meta-phosphates), phosphonates, phytic acid, silicates, carbonates (including bicarbonates and sesquicarbonates), sulphates, and aluminosilicates. Borate builders, as well as builders containing borate-forming materials that can produce borate under detergent storage or wash conditions (hereinafter, collectively "borate builders"), can also be used. Preferably, non-borate builders are used in the compositions of the invention intended for use at wash conditions less than about 50° C., especially less than about 40° C.

Examples of silicate builders are the alkali metal silicates, particularly those having a $SiO_2$:$Na_2O$ ratio in the range 1.6:1 to 3.2:1 and layered silicates, such as the layered sodium silicates described in U.S. Pat. No. 4,664,839, issued May 12, 1987 to H. P. Rieck, incorporated herein by reference. However, other silicates may also be useful such as for example magnesium silicate, which can serve as a crispening agent in granular formulations, as a stabilizing agent for oxygen bleaches, and as a component of suds control systems.

Examples of carbonate builders are the alkaline earth and alkali metal carbonates, including sodium carbonate and sesquicarbonate and mixtures thereof with ultra-fine calcium carbonate as disclosed in German Patent Application No. 2,321,001 published on Nov. 15, 1973, the disclosure of which is incorporated herein by reference.

Aluminosilicate builders are useful in the present invention. Aluminosilicate builders are of great importance in most currently marketed heavy duty granular detergent compositions, and can also be a significant builder ingredient in liquid detergent formulations. Aluminosilicate builders include those having the empirical formula:

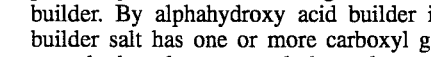

$$M_z(AlO_{2\cdot y}SiO_2)$$

wherein M is sodium, potassium, ammonium or substituted ammonium, z is from about 0.5 to about 2; and y is 1; this material having a magnesium ion exchange capacity of at least about 50 milligram equivalents of $CaCO_3$ hardness per gram of anhydrous aluminosilicate. Preferred aluminosilicates are zeolite builders which have the formula:

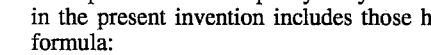

$$Na_z[(AlO_2)_z(SiO_2)_y]\cdot XH_2O$$

wherein z and y are integers of at least 6, the molar ratio of z to y is in the range from 1.0 to about 0.5, and x is an integer from about 15 to about 264.

Useful aluminosilicate ion exchange materials are commercially available. These aluminosilicates can be crystalline or amorphous in structure and can be naturally-occurring aluminosilicates or synthetically derived. A method for producing aluminosilicate ion exchange materials is disclosed in U.S. Pat. No. 3,985,669, Krummel, et al., issued Oct. 12, 1976, incorporated herein by reference. Preferred synthetic crystalline aluminosilicate ion exchange materials useful herein are available under the designations Zeolite A, Zeolite P (B), and Zeolite X. In an especially preferred embodiment, the crystalline aluminosilicate ion exchange material has the formula:

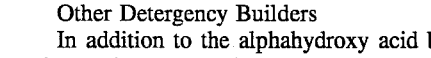

$$Na_{12}[(AlO_2)_{12}(SiO_2)_{12}]\cdot xH_2O$$

wherein x is from about 20 to about 30, especially about 27. This material is known as Zeolite A. Preferably, the aluminosilicate has a particle size of about 0.1–10 microns in diameter.

Specific examples of polyphosphates are the alkali metal tripolyphosphates, sodium, potassium and ammonium pyrophosphate, sodium and potassium and ammonium pyrophosphate, sodium and potassium orthophosphate, sodium polymeta phosphate in which the degree of polymerization ranges from about 6 to about 21, and salts of phytic acid.

Examples of phosphonate builder salts are the water-soluble salts of ethane 1-hydroxy-1, 1-diphosphonate particularly the sodium and potassium salts, the water-soluble salts of methylene diphosphonic acid e.g. the trisodium and tripotassium salts and the water-soluble salts of substituted methylene diphosphonic acids, such as the trisodium and tripotassium ethylidene, isopyropylidene benzylmethylidene and halo methylidene phosphonates. Phosphonate builder salts of the aforementioned types are disclosed in U.S. Pat. Nos. 3,159,581 and 3,213,030 issued Dec. 1, 1964 and Oct. 19, 1965, to Diehl; U.S. Pat. No. 3,422,021 issued Jan. 14, 1969, to Roy; and U.S. Pat. Nos. 3,400,148 and 3,422,137 issued Sep. 3, 1968, and Jan. 14, 1969 to Quimby, said disclosures being incorporated herein by reference.

Organic detergent builders preferred for the purposes of the present invention include a wide variety of polycarboxylate compounds. As used herein, "polycarboxylate" refers to compounds having a plurality of carboxylate groups, preferably at least two carboxylates.

Polycarboxylate builder can generally be added to the composition in acid form, but can also be added in the form of a neutralized salt. When utilized in salt form, alkali metals, such as sodium, potassium, and lithium, or alkanolammonium salts are preferred.

Included among the polycarboxylate builders are a variety of categories of useful materials. One important category of polycarboxylate builders encompasses the ether polycarboxylates. A number of ether polycarboxylates have been disclosed for use as detergent builders. Examples of useful ether polycarboxylates include oxydisuccinate, as disclosed in Berg, U.S. Pat. No. 3,128,287, issued Apr. 7, 1964, and Lamberti et al., U.S. Pat. No. 3,635,830, issued Jan. 18, 1972, both of which are incorporated herein by reference.

Still other ether polycarboxylates include copolymers of maleic anhydride with ethylene or vinyl methyl ether, 1, 3, 5-trihydroxy benzene-2, 4, 6-trisulphonic acid, and carboxymethyl oxysuccinic acid.

Organic polycarboxylate builders also include the various alkali metal, ammonium and substituted ammonium salts of polyacetic acids. Examples include the sodium, potassium, lithium, ammonium and substituted ammonium salts of ethylenediamine tetraacetic acid, and nitrilotriacetic acid.

Also included are polycarboxylates such as mellitic acid, succinic acid, oxydisuccinic acid, polymaleic acid, benzene 1,3,5-tricarboxylic acid, and carboxymethyloxysuccinic acid, and soluble salts thereof.

Other carboxylate builders include the carboxylated carbohydrates disclosed in U.S. Pat. No. 3,723,322, Diehl, issued Mar. 28, 1973, incorporated herein by reference.

Also suitable in the detergent compositions of the present invention are the 3,3-dicarboxy-4-oxa-1,6-hexanedioates and the related compounds disclosed in U.S. Pat. No. 4,566,984, Bush, issued Jan. 28, 1986, incorporated herein by reference. Useful succinic acid builders include the $C_5$–$C_{20}$ alkyl succinic acids and salts thereof. A particularly preferred compound of this type is dodecenylsuccinic acid. Alkyl succinic acids typically are of the general formula R—CH(COOH)$CH_2$(COOH) i.e., derivatives of succinic acid, wherein R is hydrocarbon, e.g., $C_{10}$–$C_{20}$ alkyl or alkenyl, preferably $C_{12}$–$C_{16}$ or wherein R may be substituted with hydroxyl, sulfo, sulfoxy or sulfone substituents, all as described in the above-mentioned patents.

The succinate builders are preferably used in the form of their water-soluble salts, including the sodium, potassium, ammonium and alkanolammonium salts.

Specific examples of succinate builders include: laurylsuccinate, myristyl succinate, palmityl succinate, 2-dodecenylsuccinate (preferred), 2-pentadecenylsuccinate, and the like. Laurylsuccinates are the preferred builders of this group, and are described in European Patent Application 86200690.5/0,200,263, published Nov. 5, 1986.

Examples of useful builders also include sodium and potassium carboxymethyloxymalonate, carboxymethyloxysuccinate, cis-cyclo-hexane-hexacarboxylate, cis-cyclopentane-tetracarboxylate, water-soluble polyacrylates (these polyacrylates having molecular weights to above about 2,000 can also be effecitvly utilized as dispersants), and the copolymers of maleic anhydride with vinyl methyl ether or ethylene.

Other suitable polycarboxylates are the polyacetal carboxylates disclosed in U.S. Pat. No. 4,144,226, Crutchfield et al., issued Mar. 13, 1979, incorporated herein by reference. These polyacetal carboxylates can be prepared by bringing together, under polymerization conditions, an ester of glyoxylic acid and a polymerization initiator. The resulting polyacetal carboxylate ester is then attached to chemically stable end groups to stabilize the polyacetal carboxylate against rapid depolymerization in alkaline solution, converted to the corresponding salt, and added to a surfactant.

Polycarboxylate builders are also disclosed in U.S. Pat. No. 3,308,067, Diehl, issued Mar. 7, 1967, incorporated herein by reference. Such materials include the water-soluble salts of homo- and copolymers of aliphatic carboxylic acids such as maleic acid, itaconic acid, mesaconic acid, fumaric acid, aconitic acid, citraconic acid and methylenemalonic acid.

Other organic builders known in the art can also be used. For example, monocarboxylic acids, and soluble salts thereof, having long chain hydrocarbyls can be utilized. These would include materials generally referred to as "soaps." Chain lengths of $C_{10}$–$C_{20}$ are typically utilized. The hydrocarbyls can be saturated or unsaturated.

Soil Release Agent

Any soil release agents known to those skilled in the art can be employed in the practice of this invention. Preferred polymeric soil release agents are characterized by having both hydrophilic segments, to hydrophilize the surface of hydrophobic fibers, such as polyester and nylon, and hydrophobic segments, to deposit upon hydrophobic fibers and remain adhered thereto through completion of washing and rinsing cycles and, thus, serve as an anchor for the hydrophilic segments. This can enable stains occurring subsequent to treatment with the soil release agent to be more easily cleaned in later washing procedures.

Whereas it can be beneficial to utilize polymeric soil release agents in any of the detergent compositions hereof, especially those compositions utilized for laundry or other applications wherein removal of grease and oil from hydrophobic surfaces is needed, the presence of polyhydroxy fatty acid amide in detergent compositions also containing anionic surfactants can enhance performance of many of the more commonly utilized types of polymeric soil release agents. Anionic surfactants interfere with the ability of certain soil release agents to deposit upon and adhere to hydrophobic surfaces. These polymeric soil release agents have nonionic hydrophile segments or hydrophobe segments which are anionic surfactant-interactive.

Typical polymeric soil release agents useful in this invention include those having: (a) one or more nonionic hydrophile components consisting essentially of (i) polyoxyethylene segments with a degree of polymerization of at least 2, or (ii) oxypropylene or polyoxypropylene segments with a degree of polymerization of from 2 to 10, wherein said hydrophile segment does not encompass any oxypropylene unit unless it is bonded to adjacent moieties at each end by ether linkages, or (iii) a mixture of oxyalkylene units comprising oxyethylene and from 1 to about 30 oxypropylene units wherein said mixture contains a sufficient amount of oxyethylene units such that the hydrophile component has hydrophilicity great enough to increase the hydrophilicity of conventional polyester synthetic fiber surfaces upon deposit of the soil release agent on such surface, said hydrophile segments preferably comprising at least about 25% oxyethylene units and more preferably, especially for such components having about 20 to 30 oxypropylene units, at least about 50% oxyethylene units; or (b) one or more hydrophobe components comprising (i) $C_3$ oxyalkylene terephthalate segments, wherein, if said hydrophobe components also comprise oxyethylene terephthalate, the ratio of oxyethylene terephthalate: $C_3$ oxyalkylene terephthalate units is about 2:1 or lower, (ii) $C_4$–$C_6$ alkylene or oxy $C_4$–$C_6$ alkylene segments, or mixtures thereof, (iii) poly (vinyl ester) segments, preferably poly(vinyl acetate), having a degree of polymerization of at least 2, or (iv) $C_1$–$C_4$ alkyl ether or $C_4$ hydroxyalkyl ether substituents, or mixtures thereof, wherein said substituents are present in the form of $C_1$–$C_4$ alkyl ether or $C_4$ hydroxyalkyl ether cellulose derivatives, or mixtures thereof, and such cellulose derivatives are amphiphilic, whereby they have a sufficient level of $C_1$–$C_4$ alkyl ether and/or $C_4$ hydroxyalkyl ether units to deposit upon conventional polyester synthetic fiber surfaces and retain a sufficient level of hydroxyls, once adhered to such conventional synthetic fiber surface, to increase fiber surface hydrophilicity, or a combination of (a) and (b).

Useful soil release polymers are described in U.S. Pat. No. 4,000,093, issued Dec. 28, 1976 to Nicol et al., European Patent Application 0 219 048, published Apr. 22, 1987 by Kud et al. U.S. Pat. No. 3,959,230 to Hays, issued May 25, 1976, U.S. Pat. No. 3,893,929 to Basadur issued Jul. 8, 1975, U.S. Pat. No. 4,702,857, issued Oct. 27, 1987 to Gosselink, U.S. Pat. No. 4,711,730, issued Dec. 8, 1987 to Gosselink et al., U.S. Pat. No. 4,721,580, issued Jan. 26, 1988 to Gosselink, U.S. Pat. No. 4,702,857, issued Oct. 27, 1987 to Gosselink, U.S. Pat. No. 4,877,896, issued Oct. 31, 1989 to Maldonado et al. All of these patents are incorporated herein by reference.

If utilized, soil release agents will generally comprise from about 0.01% to about 10.0%, by weight, of the detergent compositions herein, typically from about 0.1% to about 5%, preferably from about 0.2% to about 3.0%.

Chelating Agents

The detergent compositions herein may also optionally contain one or more iron and manganese chelating agents as a builder adjunct material. Such chelating agents can be selected from the group consisting of amino carboxylates, amino phosphonates, polyfunctionally-substituted aromatic chelating agents and mixtures thereof, all as hereinafter defined. Without intending to be bound by theory, it is believed that the benefit of these materials is due in part to their exceptional ability to remove iron and manganese ions from washing solutions by formation of soluble chelates.

Amino carboxylates useful as optional chelating agents in compositions of the invention can have one or more, preferably at least two, units of the substructure

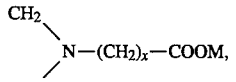

wherein M is hydrogen, alkali metal, ammonium or substituted ammonium (e.g. ethanolamine) and x is from 1 to about 3, preferably 1. Preferably, these amino carboxylates do not contain alkyl or alkenyl groups with more than about 6 carbon atoms. Operable amine carboxylates include ethylenediaminetetraacetates, N-hydroxyethylethylenediaminetriacetates, nitrilotriacetates, ethylenediamine tetrapropionates, triethylenetetraaminehexaacetates, diethylenetriaminepentaacetates, and ethanoldiglycines, alkali metal, ammonium, and substituted ammonium salts thereof and mixtures thereof.

Amino phosphonates are also suitable for use as chelating agents in the compositions of the invention when at least low levels of total phosphorus are permitted in detergent compositions. Compounds with one or more, preferably at least two, units of the substructure

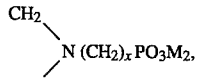

wherein M is hydrogen, alkali metal, ammonium or substituted ammonium and x is from 1 to about 3, preferably 1, are useful and include ethylenediaminetetrakis (methylenephosphonates), nitrilotris (methylenephosphonates) and diethylenetriaminepentakis (methylenephosphonates). Preferably, these amino phosphonates do not contain alkyl or alkenyl groups with more than about 6 carbon atoms. Alkylene groups can be shared by substructures.

Polyfunctionally—substituted aromatic chelating agents are also useful in the compositions herein. These materials can comprise compounds having the general formula

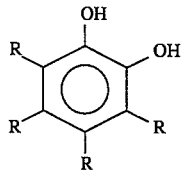

wherein at least one R is —$SO_3H$ or —COOH or soluble salts thereof and mixtures thereof. U.S. Pat. No. 3,812,044, issued May 21, 1974, to Connor et al., incorporated herein by reference, discloses polyfunctionally—substituted aromatic chelating and sequestering agents. Preferred compounds of this type in acid form are dihydroxydisulfobenzenes such as 1,2-dihydroxy-3,5-disulfobenzene. Alkaline detergent compositions can contain these materials in the form of alkali metal, ammonium or substituted ammonium (e.g. mono-or triethanol-amine) salts.

If utilized, these chelating agents will generally comprise from about 0.1% to about 10% by weight of the detergent compositions herein. More preferably chelating agents will comprise from about 0.1% to about 3.0% by weight of such compositions.

Clay Soil Removal/Anti-redeposition Agents

The compositions of the present invention can also optionally contain water-soluble ethoxylated amines having clay soil removal and anti-redeposition properties. Liquid detergent compositions which contain these compounds typically contain from about 0.01% to 5%.

The most preferred soil release and anti-redeposition agent is ethoxylated tetraethylenepentamine. Exemplary ethoxylated amines are further described in U.S. Pat. No. 4,597,898, VanderMeer, issued Jul. 1, 1986, incorporated herein by reference. Another group of preferred clay soil removal/anti-redeposition agents are the cationic compounds disclosed in European Patent Application 111,965, Oh and Gosselink, published Jun. 27, 1984, incorporated herein by reference. Other clay soil removal/anti-redeposition agents which can be used include the ethoxylated amine polymers disclosed in European Patent Application 111,984, Gosselink, published Jun. 27, 1984; the zwitterionic polymers disclosed in European Patent Application 112,592, Gosselink, published Jul. 4, 1984; and the amine oxides disclosed in U.S. Pat. No. 4,548,744, Connor, issued Oct. 22, 1985, all of which are incorporated herein by reference.

Other clay soil removal and/or anti redeposition agents known in the art can also be utilized in the compositions hereof. Another type of preferred anti-redeposition agent includes the carboxymethylcellulose (CMC) materials. These materials are well known in the art.

Polymeric Dispersing Agents

Polymeric dispersing agents can advantageously be utilized in the compositions hereof. These materials can aid in calcium and magnesium hardness control. Suitable polymeric dispersing agents include polymeric polycarboxylates and polyethylene glycols, although others known in the art can also be used.

Suitable polymeric dispersing agents for use herein are described in U.S. Pat. No. 3,308,067, Diehl, issued Mar. 7, 1967, and European Patent Application No. 66915, published Dec. 15, 1982, both incorporated herein by reference.

Brightener

Any suitable optical brighteners or other brightening or whitening agents known in the art can be incorporated into the detergent compositions hereof.

Commercial optical brighteners which may be useful in the present invention can be classified into subgroups which include, but are not necessarily limited to, derivatives of stilbene, pyrazoline, coumarin, carboxylic acid, methinecyanines, dibenzothiphene-5,5-dioxide, azoles, 5- and 6-membered-ring heterocycles, and other miscellaneous agents. Examples of such brighteners are disclosed in "The Production and Application of Fluorescent Brightening Agents", M. Zahradnik, Published by John Wiley & Sons, New York (1982), the disclosure of which is incorporated herein by reference.

Suds Suppressors

Compounds known, or which become known, for reducing or suppressing the formation of suds can be incorporated into the compositions of the present invention. Suitable suds suppressors are described in Kirk Othmer Encyclopedia of Chemical Technology, Third Edition, Volume 7, pages 430–447 (John Wiley & Sons, Inc., 1979), U.S. Pat. No. 2,954,347, issued Sep. 27, 1960 to St. John, U.S. Pat. No. 4,265,779, issued May 5, 1981 to Gandolfo et al., U.S. Pat. No. 4,265,779, issued May 5, 1981 to Gandolfo et al. and European Patent Application No. 89307851.9, published Feb. 7, 1990, U.S. Pat. No. 3,455,839, German Patent Application DOS 2,124,526, U.S. Pat. No. 3,933,672, Bartolotta et al., and U.S. Pat. No. 4,652,392, Baginski et al., issued Mar. 24, 1987. All are incorporated herein by reference.

The compositions hereof will generally comprise from 0% to about 5% of suds suppressor.

Other Ingredients

A wide variety of other ingredients useful in detergent compositions can be included in the compositions hereof, including other active ingredients, carriers, hydrotropes, processing aids, dyes or pigments, solvents for liquid formulations, bleaches, bleach activators, etc.

Liquid detergent compositions can contain water and other solvents as carriers. Low molecular weight primary or secondary alcohols exemplified by methanol, ethanol, propanol, and isopropanol are suitable. Monohydric alcohols are preferred for solubilizing surfactant, but polyols such as those containing from 2 to about 6 carbon atoms and from 2 to about 6 hydroxy groups (e.g., ethylene glycol, glycerine, and 1,2-propanediol) can also be used.

Liquid Compositions

Preferred heavy duty liquid laundry detergent compositions hereof will preferably be formulated such that during use in aqueous cleaning operations, the wash water will have a pH of between about 6.5 and 11.0, preferably between about 7.0 and 8.5. The compositions herein preferably have a pH in a 10% solution in water at 20° C. of between about 6.5 and 11.0, preferably 7.0 to 8.5. Techniques for controlling pH at recommended usage levels include the use of buffers, alkalis, acids, etc., and are well known to those skilled in the art.

This invention further provides a method for cleaning substrate, such as fibers, fabrics, hard surfaces, skin, etc., by contacting said substrate, with a liquid detergent composition comprising detersive surfactant, proteolytic enzyme, a detergent-compatible second enzyme, and the mixture of boric acid and a polyol described above. Agitation is preferably provided for enhancing cleaning. Suitable means for providing agitation include rubbing by hand or preferably with use of a brush, sponge, cloth, mop, or other cleaning device, automatic laundry washing machines, automatic dishwashers, etc.

Preferred herein are concentrated liquid detergent compositions. By "concentrated" is meant that these compositions will deliver to the wash the same amount of active detersive ingredients at a reduced dosage. Typical regular dosage of heavy duty liquids is 118 milliliters in the U.S. (about ½ cup) and 180 milliliters in Europe.

Concentrated heavy duty liquids herein contain about 10 to 100 weight % more active detersive ingredients than regular heavy duty liquids, and are dosed at less than ½ cup depending upon their active levels. This invention becomes even more useful in concentrated formulations because there are more actives to interfere with enzyme performance. Preferred are heavy duty liquid laundry detergent compositions with from about 30 to 90, preferably 40 to 80, most preferably 50 to 60, weight % of active detersive ingredients.

The following examples illustrate the compositions of the present invention. All parts, percentages and ratios used herein are by weight unless otherwise specified.

EXAMPLES 1–11

A base composition is made as shown below and used in Examples 1–11.

Base Matrix A

| | INGREDIENT | WT % |
|---|---|---|
| 1) | $C_{12.3}$ Linear alkylbenzene sulfonic acid | 8.43 |
| 2) | $C_{14-15}$ Alkyl ether (2.25) sulfonic acid | 8.43 |
| 3) | $C_{12-13}$ Alkyl ethoxylate (6.5) | 3.37 |
| 4) | Dodecyl trimethyl ammonium chloride | 0.51 |
| 5) | Monoethanolamine | 1.05 |
| 6) | Sodium hydroxide | 3.85 |
| 7) | Ethanol | 1.12 |
| 8) | Sodium cumene sulfonate | 3.16 |
| 9) | Citric acid | 3.37 |
| 10) | Tetraethylene pentaamine ethoxylate | 1.48 |
| 11) | $C_{12-14}$ fatty acid | 2.95 |
| 12) | Water/misc. | 32.28 |
| 13) | Ingredients per Examples 1–11 | 30.00 |
| | TOTAL | 100.00 |

Base Matrix A is prepared by addition of the above ingredients. It is then used in preparation of the formulations in the Examples 1–11.

| | | EX. 1 WT % | EX. 2 WT % | EX. 3 WT % |
|---|---|---|---|---|
| 1) | Base Matrix A | 70.00 | 70.00 | 70.00 |
| 2) | Sodium tartrate mono- and di-succinate (80:20 mix) | 3.37 | 3.37 | 3.37 |
| 3) | Sodium formate | 0.15 | 0.15 | 0.15 |
| 4) | Boric acid | — | 2.00 | — |
| 5) | 1,2 Propane diol | — | — | 4.00 |
| 6) | Protease B (34 g/L) | 0.70 | 0.70 | 0.70 |
| 7) | Lipase (100 KLU/g) | 0.90 | 0.75 | 0.75 |
| 8) | Water/misc. | 24.88 | 23.03 | 21.03 |
| | TOTAL | 100.00 | 100.00 | 100.00 |

| | | EX. 4 WT % | EX. 5 WT % | EX. 6 WT % |
|---|---|---|---|---|
| 1) | Base Matrix A | 70.00 | 70.00 | 70.00 |
| 2) | Sodium tartrate mono- and di-succinate (80:20 mix) | 3.37 | 3.37 | 3.37 |
| 3) | Sodium formate | 0.15 | 0.15 | 0.15 |
| 4) | Boric acid | 2.00 | 2.00 | 2.00 |
| 5) | 1,2 Propanediol | 4.00 | — | — |
| 6) | 1,2 Butanediol | — | 4.00 | — |
| 7) | 3 Chloro 1,2 propanediol | — | — | 4.00 |
| 8) | Protease B (34 g/L) | 0.70 | 0.70 | 0.70 |
| 9) | Lipase (100 KLU/g) | 0.90 | 0.90 | 0.90 |
| 10) | Water/misc. | 18.88 | 18.88 | 18.88 |
| | TOTAL | 100.00 | 100.00 | 100.00 |

| | | EX. 7 WT % | EX. 8 WT % | EX. 9 WT % |
|---|---|---|---|---|
| 1) | Base Matrix A | 70.00 | 70.00 | 64.00 |
| 2) | Sodium tartrate mono- and di-succinate (80:20 mix) | 3.37 | 3.37 | 3.37 |
| 3) | Sodium formate | 0.15 | 0.15 | 0.15 |
| 4) | Boric acid | 2.00 | 2.00 | 2.00 |
| 5) | 2,3 Dihydroxy benzaldehyde | 4.00 | — | |
| 6) | 1,2 Hexanediol | — | 4.00 | — |
| 7) | Sorbitol | — | — | 4.00 |
| 8) | Protease B (34 g/L) | 0.70 | 0.70 | 0.70 |
| 9) | Lipase (100 KLU/g) | 0.90 | 0.90 | 0.90 |
| 10) | Water/misc. | 18.88 | 18.88 | 18.88 |
| | TOTAL | 100.00 | 100.00 | 100.00 |

| | | EX. 10 WT % | EX. 11 WT % |
|---|---|---|---|
| 1) | Base Matrix A | 70.00 | 70.00 |
| 2) | Sodium tartrate mono- and di-succinate (80:20 mix) | 3.37 | 3.37 |
| 3) | Sodium formate | 0.15 | 0.15 |
| 4) | Boric acid | 2.00 | 2.00 |
| 5) | Sucrose | 4.00 | — |
| 6) | Mannose | — | 4.00 |
| 7) | Protease B (34 g/L) | 0.70 | 0.70 |
| 8) | Lipase (100 KLU/g) | 0.90 | 0.90 |
| 9) | Water/misc. | 18.88 | 18.88 |
| | TOTAL | 100.00 | 100.00 |

(pH = 7.8 to 8.3)

Method Used to Determine Residual Lipase Activity

Initial lipase activity is measured using a pH-stat computer assisted titrimeter. Titration mixture is prepared using 10 mM calcium chloride (CaC12), 20 mM sodium chloride (NaCl) and 5 mM tris buffer at a pH of 8.5–8.8. A commercial lipase substrate containing 5.0 wt % olive oil, and an emulsifier is used. 100 microliters of the detergent composition is added to the mixture. The fatty acids formed by lipase-catalysed hydrolysis are titrated against a standard sodium hydroxide solution. The slope of the titration curve is taken as the measure of lipase activity. Initial activity is measured immediately after the composition is prepared. The samples are then aged at 90° F. (32.2° C.) and the residual activity is measured after two to three weeks of storage at 90° F. The residual activity in Table 1 below is reported as the percentage of initial activity. The thermodynamic constants $K_1$ and $K_2$ as determined by $^{11}B$ N.M.R. have also been tabulated.

TABLE 1

| | K1 | K2 | % Residual Lipase Activity at 90° F. 14 days |
|---|---|---|---|
| Example 1 | — | — | 0 |
| Example 2 | — | — | 30 |
| Example 3 | — | — | 0 |
| Example 4 | 3.1 | 14 | 68 |
| Example 5 | 3.6 | 5.4 | 94 |
| Example 6 | 9.8 | 27 | 97 |
| Example 7 | na | na | 86 |
| Example 8 | 3.6 | 5.9 | 84 |
| Example 9 | 311 | 33000 | 31 |
| Example 10 | 0 | 0 | 44 |
| Example 11 | 199 | 1194 | 43 |

Conclusion: It is seen that boric acid or polyol by themselves do not provide sufficient stability to lipase in a heavy-duty liquid composition containing proteolytic enzyme. The stability is improved by using a mixture of boric acid and 1,2 propanediol (Example 4). Surprisingly, it is seen that by using a mixture of boric acid and polyol as described herein (Examples 5–8), significantly higher lipase stability is observed than with boric acid, propanediol (or a combination thereof) alone. It is concluded that for superior lipase stability, the polyol to boric acid complexation reaction should have a $K_1$ between about 0.1 and 400 l/mole and a $K_2$ between 0 and about 1000 $l^2$/mole$^2$. If these values fall outside the above ranges (Examples 9–11), poor lipase stability is obtained. Other compositions of the present invention are obtained when Protease B is substituted with other proteases such as Savinase® and BPN', and/or lipase is substituted by other second enzymes such as amylase.

EXAMPLES 12–14

A base composition for a concentrated heavy-duty liquid detergent composition is prepared as shown below and used in

EXAMPLES 12–14:

Base Matrix B

| | INGREDIENT | WT % |
|---|---|---|
| 1) | $C_{12.3}$ Linear alkylbenzene sulfonic acid | 12.6 |
| 2) | $C_{14-15}$ Alkyl ether (2.25) sulfonic acid | 10.6 |
| 3) | $C_{12-13}$ Alkyl ethoxylate (6.5) | 2.4 |
| 4) | Monoethanolamine | 1.0 |
| 5) | Sodium hydroxide | 3.5 |
| 6) | 1,2 propane diol | 4.0 |
| 7) | Ethanol | 1.5 |
| 8) | Sodium cumene sulfonate | 6.0 |
| 9) | Citric acid | 4.0 |
| 10) | Tetraethylene pentaamine ethoxylate | 1.5 |

-continued

| Base Matrix B | | |
|---|---|---|
| INGREDIENT | | WT % |
| 11) | $C_{12-14}$ fatty acid | 2.0 |
| 12) | Water/misc. | 16.9 |
| 13) | Ingredients per Examples 12–14 | 34.00 |
| | TOTAL | 100.00 |

Base Matrix B is used for preparation of Examples 12–14.

| | EX. 12 WT % | EX. 13 WT % | EX. 14 WT % |
|---|---|---|---|
| 1) Base Matrix 1 | 64.00 | 64.00 | 64.00 |
| 2) Sodium tartrate mono- and di-succinate (80:20 mix) | 3.00 | 3.00 | 3.00 |
| 3) Sodium formate | 0.15 | 0.15 | 0.15 |
| 4) Boric acid | 2.00 | 2.00 | 2.00 |
| 5) 1,2 Butanediol | 4.00 | — | — |
| 6) 3 Chloro 1,2 propanediol | — | 4.00 | — |
| 7) 2,3 Dihydroxy benzaldehyde | — | — | 4.00 |
| 8) Protease B (34 g/L) | 0.70 | 0.70 | 0.70 |
| 9) Lipase (100 KLU/g) | 0.90 | 0.90 | 0.90 |
| 10) Water/misc. | 25.25 | 25.25 | 25.25 |
| TOTAL | 100.00 | 100.00 | 100.00 |

(pH = 7.8 to 8.3)

Other compositions of the present invention are obtained when Protease B is substituted with other proteases such as Alcalase®, Savinase®, and BPN', and/or lipase is substituted by or used in conjunction with other second enzymes such as amylase.

What is claimed is:

1. A liquid detergent composition comprising:

A) a boric-polyol complex formed by reacting a boron compound selected from the group consisting of boric acid, borax and boric oxide, with a vicinal polyol selected from 3-chloro- 1,2-propanediol, 1 -phenyl-1,2-ethanediol and propylgallate; wherein in forming said complex the boron compound is used in an amount which comprises from about 0.05% to 20% by weight of the composition and the vicinal polyol is used in an amount which comprises from about 0.1% to 30% by weight of the composition, and wherein the molar ratio of boron compound to vicinal polyol ranges from about 3:1 to 1:10;

B) from about 0.0001 to 1.0 weight % of active proteolytic enzyme;

C) a performance-enhancing amount of a second enzyme selected from the group consisting of lipase, amylase, cellulase and mixtures thereof;

D) from about 1 to 80 weight % of a surfactant selected from anionic surfactants, nonionic surfactants and mixtures thereof; and E) from about 0.1 to 30 weight % of alphahydroxyacid builder.

* * * * *